United States Patent [19]

Sullivan

[11] 4,145,774

[45] Mar. 27, 1979

[54] DUAL FLUSH APPARATUS FOR WATER CLOSETS

[76] Inventor: Donald E. Sullivan, 1493 Fahlander Dr., S., Columbus, Ohio 43229

[21] Appl. No.: 808,046

[22] Filed: Jun. 20, 1977

[51] Int. Cl.[2] ..... E03D 1/14

[52] U.S. Cl. ..... 4/325; 4/249; 4/405; 4/415

[58] Field of Search ..... 4/67 A, 67 R, 249, 250, 4/325, 324, 405, 415

[56] References Cited

U.S. PATENT DOCUMENTS

| | | | |
|---|---|---|---|
| 2,883,675 | 4/1959 | Hartman | 4/324 |
| 3,278,948 | 10/1966 | Jensen | 4/405 |
| 3,955,218 | 5/1976 | Ramsey | 4/67 A |
| 4,014,050 | 3/1977 | Goldsworthy | 4/67 A |
| 4,038,707 | 8/1977 | Cass | 4/249 |
| 4,080,668 | 3/1978 | Banes | 4/249 |

*Primary Examiner*—Lenard A. Footland
*Attorney, Agent, or Firm*—Frank H. Foster

[57] ABSTRACT

A dual flush apparatus for selecting one flushing mode in which all the water in the toilet tank is drained or another mode wherein only a portion of the water is drained. A toilet valve actuating handle is bistable so that it is yieldably biased to two positions. It is linked to a toilet flushing valve so that it can open the valve and in one of its bistable positions apply a force on the valve and in the other not apply such a force. Depending upon the particular valve structure to which the handle is linked, the force which the handle applies, when applied either prevents or enables the premature closure of the valve at an intermediate water tank level. One flushing mode occurs when the handle force is applied and the other mode occurs when the force is not applied. A conventional pivotable ball valve is modified by providing an air escape hole into the ball below its valve seal to permit controlled entry of water into the valve so that its buoyancy changes at an intermediate water level allowing it to prematurely close if the valve actuating handle is appropriately positioned.

9 Claims, 5 Drawing Figures

DUAL FLUSH APPARATUS FOR WATER CLOSETS

BACKGROUND OF THE INVENTION

This invention relates to a selective two-flushing system for bathroom water closets.

With the ever increasing population and the drain on all of the natural resources throughout the world, water is becoming more limited and expensive as each year passes.

Many mechanical devices, suggestions for saving water and new inventions such as shower heads, flushing devices and raised outlet adapters have been introduced by those who have been quick to recognize the importance of our dwindling water supply.

The ordinary bathroom toilet tank is a notorious waster of our already limited water supply. In most cases the water which is wasted is not really toilet water but purified drinking water.

Prior art shows many flushing systems for this purpose, some of which would appear to work quite well. However, some of these devices are difficult to install and for many people would require the services of a plumber to completely remove and reinstall the water tank. Other devices employ various types of springs, etc., which operate under water and can become corroded or limed up and eventually stick or fail to function properly.

Some devices require dual valves, guide rods, dual outlets and all of the extra equipment that is needed for this type of system and would eventually require double replacement of parts and increase the risk of leakage. Other devices require the use of air lines with sophisticated air control valves in the valve ball or the handle or in both. Also many of these devices are not adaptable to a wide enough variety of existing equipment such as tanks which are very small and require total discharge of water at times. In addition, some tanks have a raised porcelain valve seat or are of unusual shape or design such as low silhouette and one piece units.

These very small tanks require a particular type of valve ball such as that shown in U.S. Pat. No. 2,773,268. This type of valve is capable of discharging approximately two inches more of water from the bottom of a tank than most of the ordinary flapper valves. In a very small tank this is of course vital. But it does not eliminate the need of a dual control.

And finally there are some devices that are shown in prior art, such as U.S. Pat. Nos. 3,969,775 and 3,435,598, that have been simplified but then they are not fully automatic and would require guess work to operate which also makes them inconsistent in the use of water.

Therefore, what is needed is a device which is simplified to the maximum and is still fully automatic and consistent in operation, easy to install in a large variety of existing tanks and low in cost.

One of the objects of this invention is to provide a new and novel valve ball that may be adapted for use in most flush tanks.

Another object of this invention is to provide a simple and practical way of selectively controlling this new valve as well as the type of valves which are used in very small water closets.

Another object of this invention is to provide a novel valve actuator which permits convenient selection of either of two flush modes and provides automatic operation.

Another object of the invention is to provide a simple flapper valve which does not contain any special sloped interior walls or any moving parts within its buoyancy chamber that must be manipulated in order to provide a second control.

Another object of the invention is to provide a flushing apparatus which may be controlled without the assistance of any type of float affixed to the chain or elsewhere which might become entangled or obstruct the ball from always closing properly. Such floats which are buoyant enough to control and sustain the ball against the strong forces of water leaving the tank would, once the valve is closed, be constantly drawing or urging the ball directly upward and could possibly cause the tank to leak when the ball and valve seat become old and worn.

Another object of the invention is to provide a one piece mount which is easily adjustable in two directions in order that the two way valve ball will properly fit a very large variety of existing tanks.

Other objects and advantages of the invention will become apparent when taken into consideration with the accompanying drawings and appended claims.

Figure 1:
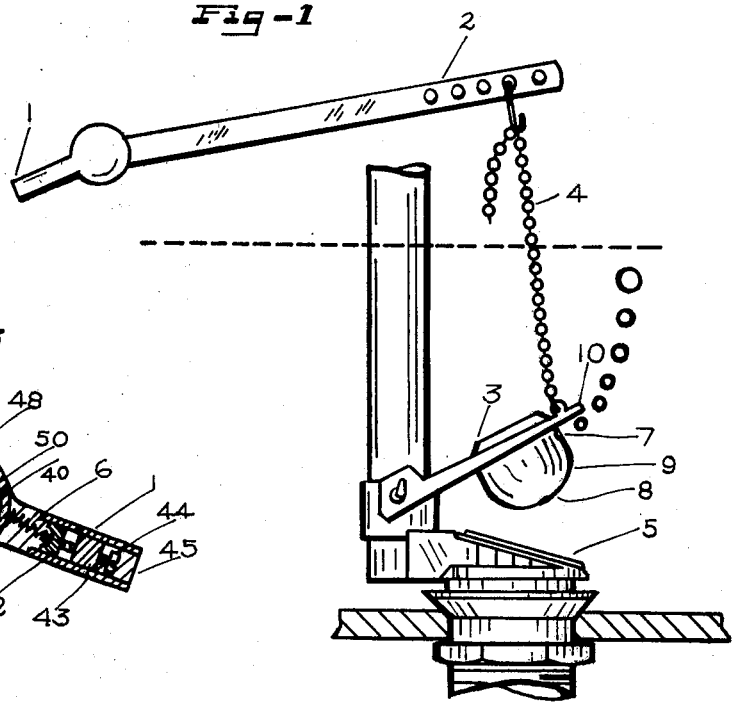
FIG. 1 is a front elevational view of a flushing tank outlet valve construction utilizing the invention in its preferred embodiment.

It should be understood that the filler valves which automatically control the intake of water into the flush tank are well known and commonly used and therefore have not been included in the drawings in order to eliminate unnecessary complications.

DETAILED DESCRIPTION

Turning now to a consideration of the drawings and to FIG. 1 in particular.

When the operating handle of a conventional tank has been pivoted as shown in this drawing, the valve ball is lifted from the discharge opening and assumes an upright position, somewhat less than vertical, which it maintains until the water level drops all the way down within the tank and reaches the level of the valve ball which then permits the ball to close and reseat itself.

During the course of this action the handle 1 had returned to its original position almost immediately after rotating the valve ball 3 because the weight of the lift arm 2 was somewhat greater than that of the handle due partly to its extended leverage.

The valve ball 3 was held in its upward position by its buoyant force because of the air that was trapped inside of its hollow body 9.

This flushing action is the common practice for most flush valves of the flapper type.

In accordance with this invention a double action concept is employed by making important changes in the ball 3 and in the handle 1.

The valve ball 3 is provided with a small air hole 7 located slightly below the sealing flange 10 of the valve ball 3.

When the ball 3 is activated, the air hole 7 is elevated to a topward position permitting air to escape into the discharging water. Since the air that is contained in the hollow portion of the ball 9 is released directly into the water through the small hole 7, its rate of discharge is fairly slow. This action is further controlled by the size of the opening 8 in the bottom of the ball through which water enters the ball to replace air which escapes through the hole.

The opening 8 is smaller than in conventional balls presently being used. For example, a ball that would have an air hole 7 of ⅛th inch diameter and a bottom hole 8 of approximately ¼th inch diameter would permit about 3½ inches of water to discharge from the tank before enough air would escape to allow the ball to drop to a closed position. It is not necessary that the air hole 7 be covered or contain any type of hose because once the ball flange 10 has been resealed to the valve rim 5, the air hole 7 is slightly below this seated area and is sealed off from the water contained within the tank. It is therefore impossible for this air hole 7 to cause the valve ball to leak water.

This type of arrangement makes the valve ball very easy to manufacture as the two holes 7 & 8 can be cast into the rubber ball (or the like) and therefore provide the ball 3 with a very low cost self timer for the purpose of attaining limited flushing to conserve water most of the time. Consequently, it can be seen that the valve ball decreases in buoyancy as it fills with water so that at some intermediate water level, its buoyant force has substantially decreased. Under certain conditions described below, it can then fall to reseal the valve at this intermediate water level.

Figure 4:
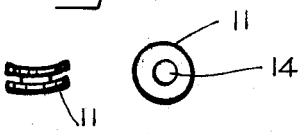
FIG. 4 is a side and front view of the adapter plug that can be used in the valve ball.

FIG. 4 shows a small plastic adapter plug 11 which can be inserted into the hole 8 in the bottom of the ball to change the intermediate level at which the valve ball 3 descends for a different size tank. The plug 11 accomplishes this by reducing or increasing the size of the ball opening 8 to vary the rate of water flow into the ball. When the ball is activated, the slower that the water enters into the ball opening 8 the slower the air is forced upward and out of the air hole 7 and the longer it takes for the valve ball to descend to a closed position for limited flushing.

The plastic adapter plugs 11 as shown in FIG. 4 can be included with the ball to accomodate various size tanks by containing holes of different diameter 14. They can also be color coordinated. For example, red might give the most water for a limited flush in a particular size tank, white might give ½ inch less and blue another ½ inch less and no plug at all would give still another ½ inch less water for various size or shaped tanks. In other words, the hole in the red plug 14 would be the smallest, the white plug would contain a slightly larger hole and the blue plug would have the largest hole 14 while no plug at all would give the ball an even slightly larger hole 8.

This system affords a consistent and precise amount of water for a given size and shaped tank for limited flushing purposes and once the proper plug has been installed it acts as a valve governor and cannot come out of adjustment in the flushing of liquids and other limited flushing requirements. It is important to note that the vast majority of flushing in most situations does not require maximum flushing. So it is therefore more important to be exact in the amount of water used for minimum flushing. This is why a precise timing control for the limited flush is preferrable over a maximum flush control float which may turn or gradually creep out of adjustment.

Also, the filler valve float rod or float cup can still be adjusted when desirable to control the amount of water required for maximum flushing to prevent septic tank problems that are sometimes caused by bottles or bricks or raised valve extensions being placed in a small water tank that has one adjustment for all purposes which may be slightly less than adequate and still waste water.

It is also important to note that whenever the proper and adequate amount of water is used for flushing solids, considerably less water is needed for all other flushing, which is most of the time.

As the size of a modern water closet is designed to release the precise amount of water necessary for maximum flushing needs so should the valve ball be designed to release the precise amount of water necessary for limited flushing requirements.

If the amount of water being flushed for either maximum or minimum needs is substantially inadequate it can be noticed almost instantly. But if either of these amounts is too much it might go undetected for very long periods of time by simply providing a clean flush and no visible signs of trouble.

The operation and control of the valve ball 3, which is within the water tank, from the handle 1 on the outside of the tank, is also a very simple operation.

If a full or maximum flush is required, the handle 1 is merely pressed down just as it would be if the tank were not equipped with any selective flushing control.

When a limited flush is desired, the handle 1 is pushed down in exactly the same way and then lifted back up to its original position by one of the index fingers in a follow-up motion. This is the only thing that is required for the limited selection and it is not necessary to hold the handle down or up and try to estimate when the tank valve should be shut off as the system is automatic in this respect for both controls.

The handle lift arm 2 which is of light weight plastic or metal can be raised with very little effort. The handle 1 is a valve actuating member which is bistable. It has a pair of stable positions into which it is yieldably biased. In the preferred embodiment it contains a spring 6 which applies pressure within the handle that increases and decreases as the handle changes positions. When the handle, which contains this spring, is pressed down it stays down because of the bias of the spring 6. The force which this spring applies to the handle is not noticeable when the handle is pushed down because it is not much greater than that required to initially lift the flapper valve open from its sealed position; but the force is adequate to hold the lift arm 2 and the valve ball 3 in an upward position by means of the chain 4 and with the help of the water within the tank, even though all of the air has been released out of the hollow of the ball 9.

However, when substantially all of the tank water is drained so that the water filled ball is not submersed in the water, its buoyant force is totally lost and its added weight overcomes the bias on the handle allowing the ball to drop and seal the valve. The ball drops and the pressure of the spring changes within the handle to release the lever completely to permit the ball to seat perfectly without any drag from the chain.

With all of the air out of the hollow part of the ball 9 so that it is filled completely with water (whereas a conventional ball would contain some air and some water) its weight is increased when the level of water drops to the level of the ball 3.

This additional weight of the valve filled with water, and acting as its own float, determines when the lift arm is pulled down to reseat itself.

The weight of the water filled ball 3 combined with the leverage obtained from the lift arm 2 is more than adequate to override and shift the handle spring 6 and permit the valve ball to drop and properly seat itself. Once this has happened, the air hole 7 reverses its previous function and provides an air intake which assists the water to rapidly drain out of the valve outlet 8 even though this opening is smaller than that which is presently used in most conventional valve balls.

When the handle 1 is pushed down and then raised for an early shut off (i.e., its other mode of operation), the spring 6 assures that it stays in this position and does not wander about because of its light weight and somewhat delicate balance. This in turn assures that the chain 4 contains all the slack that is necessary for the ball 3 to drop at the intermediate tank level and properly seat itself for a limited flush as soon as the ball is sufficiently filled with water.

It should be clearly understood that the handle spring 6 can be inserted into the handle in various ways or at a different angle, for the ease of manufacturing if it is so desired; and also in order to accomodate various shapes and styles of handles such as the pushbutton type in which the spring mechanism could be moved to inside the tank if desirable and would still be capable of accomplishing its function by controlling the valve ball from a biased lift arm.

This type of arrangement might entail one button that would utilize the spring or biased concept and another button that would by-pass the spring to activate the valve for a different flushing.

Also the air hole 7 may consist of one or more holes strategically placed below the sealing flange 10 if this were to become preferable for any future timing purpose without departing from the scope of the invention.

Figure 5:
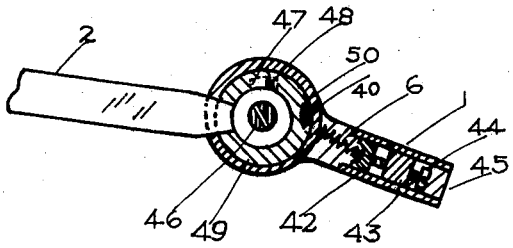
FIG. 5 is a rear view of the control mechanism which can be contained within the handle.

Turning now to FIG. 5 showing the working parts of the handle 1 with the handle depressed and the lever arm raised, it can be seen that the core 49 is fixed to the wall of the toilet tank in a conventional manner. It is held in place against axial translation by the same bolt 46 that also secures the lever arm 2 to the handle 1. The handle 1 and the lever arm 2 are fixed together and pivot together within the core 49. The handle mechanism contains mating stops 47–48 which limit the distance that the core 49 can turn within the handle. The core 49 also contains a small concave area 50 which contains a pin 40 (all of which can be molded into one piece) which holds one end of the compression spring 6. The other end of the spring 6 is mounted in a similar manner to a slideable lock 42 which can be adjusted by the turning of a small bolt 44 which is retained by a solid section 43 within the handle. The slideable lock 42 adjustably slides axially of the bolt 44 to adjust the spring force exerted by the spring against the handle and the core 49. The handle 1 can have part of its end 45 left open for access to the adjustable bolt 44. If the handle is made for one specific type of tank and valve ball the bolt adjustment can be eliminated if so desired. The purpose of this adjustment is to compensate for the difference in weight and balance of various types of valve balls. Also, the lift arm does not necessarily have to be bolted to the handle as some manufacturing processes do not employ this technique.

The handle and the lever arm 2, which it carries, are therefore bistable because when the handle is pushed downwardly to the depressed position illustrated in FIG. 5 and the lever arm is raised, they will be held in that position by the force applied by the spring 6 which is at an angle to a radius about which the handle pivots and consequently has a component of force applying a moment force against the handle 1. If the handle is in its raised position, the compression spring will be at an angle to the radius but on the other side of the radius so that it will apply a moment force in the opposite direction to releasably hold the handle in the raised position.

In the operation of the preferred embodiment, the gravitational force of the valve urges the valve closed. The buoyant force of the valve urges the valve open or is applied in a direction to hold it open. The buoyant force, however, varies from the time that the valve is opened because of two phenomena.

First, a part of the buoyant force of the valve results from the space within the valve which is occupied by air. However, after the valve is opened water begins to fill the valve and as time progresses and the valve fills this buoyant force becomes less.

Secondly, as the water level lowers in the tank and the surface of the water falls below the uppermost portion of the valve, the portions of the valve that protrude above the surface no longer exert any upward buoyant force on the valve. Therefore, as water drains from the tank both upward buoyant forces decrease. This decrease does not occur all of a sudden but rather is a continuously changing decrease.

When it is desired to flush the tank in the toilet, in a manner which conserves water, the handle is depressed and then raised to its initial raised position. In this state the lever arm 2 through the chain 4 will exert no upward or valve opening force on the valve. Therefore, as water fills the central portion of the valve and its buoyancy decreases the valve will close as soon as the buoyant forces become less than the gravitational forces.

However, when a full flush is desired the handle 1 is depressed so that the lever arm 2 remains in its upward position. Therefore, closing of the valve is further delayed until the sum of the buoyant force and the force exerted by the spring through the lever arm 2 and the chain 4 becomes less than the total gravitational forces.

One feature of this structure is that a conventional full flush is still performed by the conventional depression only of the handle.

Thus, in either mode of operation the buoyant forces must decrease sufficiently far to permit gravity to close the valve. In the water conserving mode they must only decrease sufficiently to be less than the gravitational force of the valve. However, in the full flush mode the buoyant forces must decrease still further until the gravity force can overcome the force exerted on the valve by the spring acting through the lever arm 2 and the chain 4.

Figure 2:
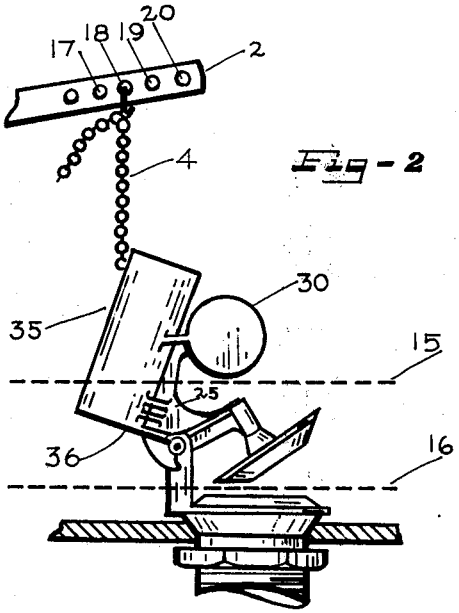
FIG. 2 is a front view of a different type of valve ball for small tanks which can also be operated with the same handle control but in a different manner.

Shown in FIG. 2 is a different type of valve which has a container 35 with a small hole located in its bottom area 36 for the purpose of timing the valve to stay open until the entire water tank has emptied; at which time this valve changes balance and drops to a closed position shown by water line 16. This action is possible only because the lever arm 2 has been lowered to provide slack in the chain 4 for the valve to travel all of the way rearward shortly after being activated. The embodiment of FIG. 2 also has a buoyant means 30, the buoyant force of which is applied to tends to open the valve but which decreases its buoyant force when the water level falls below it.

The handle and arm shown in FIG. 1 and 5 can also be used to control this type of valve by operating the handle 1 in the exact opposite manner as used to control the new improved flapper such as shown in FIG. 1. If a partial flush is desired from this type of valve the handle 1 would be pressed downward. If a full flush is desired the handle would be pressed downward and raised to permit slack in the chain.

Before fastening the lever arm 2 to the valve 25 shown in FIG. 2 the spring 6 would first be tightened slightly. The chain 4 would be hooked into one of the holes 17, 18, 19 and 20 which are located close together for the purpose of finding the exact balancing point for the valve 25 to close when the water level 15 makes contact with the lower section of the float 30. Because the valve is being held in this over balanced position by the lift arm 2 and tight chain 4, it drops forward to a closed position prematurely and before the weight of the container becomes dominant, thereby saving approximately 2 inches of water depending on the amount of slack which has been connectively permitted in the chain 4 and also depending on which of the holes 17, 18, 19 or 20 has been selected for use.

Figure 3:
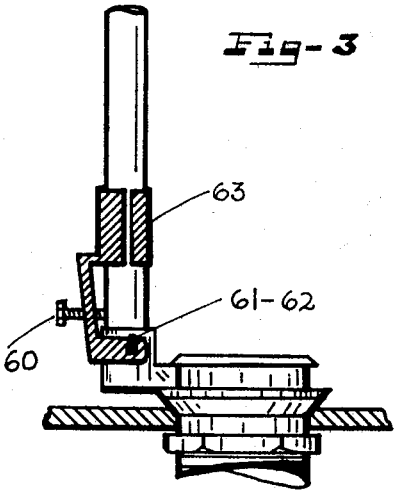
FIG. 3 shows a front view of the plastic collar as it is attached to the overflow pipe.

FIG. 3 shows a one piece plastic type of mount which slides down onto the overflow tube and rigidly grips around the tube to hold itself in the correct position to permit the valve to seat exactly each time. The sleeve 63 slides up or down slightly on the overflow tube to provide the conventional type vertical adjustment while turning of the bolt 60 moves the trunnions 61 & 62 forward or rearward for the second or exact horizontal adjustment.

It should be appreciated that various alternative structures can be designed which embody the concepts of the present invention. For example, the handle or valve actuating member can be made bistable by means of an offset weight which pivots with the handle and has a top dead center position intermediate its two bistable positions. Shifting the handle and its weight one way permits the weight to apply a moment force holding the handle there while shifting it the opposite way yieldably biases it in its opposite position.

As still another alternative, the valve actuating member can be biased into one or both stable positions by being forced by an operator into a catch, frictionally engaging clamp means or other detachable or yieldable fastener. For example, depression of the handle 1 in FIG. 1 can raise the arm into a frictionally engaging fastener where it is retained until substantially all of the water is drained from the tank whereupon the total weight pulls the arm from the fastener. When the arm 2 is in its lower position it may be biased merely by gravitational forces.

In any case, the handle or lift arm is bistable and is linked to the valve so that in one position it applies a force to the valve and in its other position it does not. It is linked so that it also is used to open the valve by moving it to one of its stable positions.

The force it applies in some embodiments, such as that of FIG. 1 prevents the loss of buoyancy at the intermediate level (i.e., the filling of the ball with water) from allowing the valve to close. In other embodiments, such as that of FIG. 2, the force applied by the bistable handle allows the valve to close at the intermediate level whereas otherwise, with no force from the bistable handle, it would not close at the intermediate level.

It is to be understood that while the detailed drawings and specific examples given describe preferred embodiments of the invention, they are for the purposes of illustration only, that the apparatus of the invention is not limited to the precise details and conditions disclosed, that the handle can be used to control many other valves which have not been shown and that various changes may be made therein without departing from the spirit of the invention which is defined by the following claims.

I claim:

1. A dual flushing valve apparatus for permitting the flow of alternatively selectable quantities of flushing water through a valve connected to a toilet reservoir tank, said apparatus comprising:

(a) a valve member movable between a closed position in sealing engagement against a valve seat and an open position, said valve in its opened position having a net gravitational force toward one of its said positions;

(b) buoyant means linked to said valve member for at times applying a buoyant force urging said valve member toward its open position, said buoyant means decreasing its buoyant force at an intermediate water level in said tank after said valve is opened; and (c) a bistable, mechanical, manually positionable, valve actuating means having a pair of stable positions in which it is yieldably biased, one of said positions being an unflushed position, the other being a flush position, said actuating means being linked to said valve member for permitting the valve to be manually opened by moving said actuating means to its flush position, said actuating means applying no force to said valve member when positioned in its unflushed one of its stable positions and applying a force on said valve member when positioned in its other flush bistable position, wherein in one of said stable positions the net forces applied to said valve member after the decrease in said buoyant force operates to close said valve and wherein in the other of said stable positions the net forces applied to said valve member after the decrease in said buoyant forces holds said valve open until substantially all of the water in said tank has been drained.

2. An apparatus according to claim 1 wherein said valve member and said buoyant means comprises a hollow, toilet valve ball having a pair of openings therein one opening for permitting the entry of water into said ball and the other opening being an air outlet opening, for consistently permitting the loss of air from said ball at a selected rate, neither of said openings being in communication with the water in said tank when said valve is closed.

3. An apparatus according to claim 2 wherein said ball has the air outlet opening immediately below its position which engages said valve seat and the water inlet opening is in its bottom.

4. An apparatus according to claim 2 wherein said valve actuating means when actuated to raise said ball and thereby open said valve applies a lifting force on said ball to oppose and prevent the closing of the valve until after substantially all the water has drained from said tank.

5. An apparatus according to claim 1 wherein said valve is of the type having a pivotable valve member and a counterweight formed by a drainable compartment and wherein said valve actuating means is linked to said valve for opposing the force of said counterweight and for holding the pivotable valve member near a balanced position when applying a force upon said valve member.

6. An apparatus according to claim 1 wherein said valve actuating means comprises a pivotable handle and a helical spring aligned radially of the pivot axis of said actuating means at an intermediate position of said actuating means, one end of said spring mounted to said handle and the other end fixed relative to said toilet tank for bistably biasing said handle.

7. An apparatus according to claim 6 wherein one end of said spring is radially adjustable for adjusting its bias force.

8. An apparatus according to claim 1 further comprising a hinge means slidably and adjustably clamped to an overflow tube of said toilet tank for mounting thereto a pivotable valve member.

9. An apparatus in accordance with claim 6 wherein said actuating means includes a lift arm fixed to said pivotable handle and positioned within said tank to provide leverage for the gravitational force of said valve applied to said actuating means.

* * * * *